US005173120A

United States Patent [19]

Suzumura et al.

[11] Patent Number: 5,173,120

[45] Date of Patent: Dec. 22, 1992

[54] COATING APPARATUS HAVING A PARTITIONED COATING CHAMBER

[75] Inventors: Hiroshi Suzumura, Hiroshima; Kazuo Hirota, Takasago; Mitsuo Yamamoto, Mihara; Hiroto Jakunen, Hiroshima, all of Japan

[73] Assignee: Mitsubishi Jukogyo Kabushiki Kaisha, Tokyo, Japan

[21] Appl. No.: 638,429

[22] Filed: Jan. 7, 1991

[30] Foreign Application Priority Data

Jan. 5, 1990 [JP] Japan ..... 2-91[U]

[51] Int. Cl.[5] ..... B05C 5/02

[52] U.S. Cl. ..... 118/410; 118/419

[58] Field of Search ..... 118/410, 419, 413; 427/356

[56] References Cited

U.S. PATENT DOCUMENTS 4,369,731 1/1983 Damrau ..... 118/410
4,839,201 6/1989 Rantanen et al. ..... 118/410 X
4,873,939 10/1989 Eskelinen ..... 118/410
4,903,632 2/1990 Sollinger ..... 118/410

FOREIGN PATENT DOCUMENTS 8400325 7/1985 Fed. Rep. of Germany .
3616645 11/1987 Fed. Rep. of Germany .
2158371 11/1985 United Kingdom .

*Primary Examiner*—Michael G. Wityshyn
*Attorney, Agent, or Firm*—Wenderoth, Lind & Ponack

[57] ABSTRACT

A coating apparatus for applying coating liquid onto a web which is being transported as wrapped around a backing roller includes a chamber from which the liquid is applied to the web and a blade for scraping the applied coating liquid into a film having a constant thickness. A partition plate divides the inside of the chamber into upstream and downstream sections with respect to the direction of travel of the web. A plate-like body resiliently held in contact with the web is mounted to an upper portion of the partition plate, and a plurality of holes are formed in a lower portion of the partition plate.

6 Claims, 1 Drawing Sheet

COATING APPARATUS HAVING A PARTITIONED COATING CHAMBER

BACKGROUND OF THE INVENTION

1. Field of the Invention

The present invention relates to a coating apparatus applicable as a paper coater in a paper making machine.

2. Description of the Prior Art

FIG. 3 shows one example of a coating machine (short dwell coater) in the prior art, in which a web (of paper) 3 is adapted to be transported as wrapped around an outer circumference of a backing roller 2. The backing roller 2 includes a drum and elastic material such as rubber or the like wrapped around the outer circumferential surface of the drum. A coating apparatus is provided at a lower portion of the aforementioned backing roller 2. The apparatus is provided with a blow-off section 5 for injecting the coating liquid vertically upward towards a lower surface of the web of paper 3, and a blade 7 integral with the blow-off section 5 at the downstream side of the apparatus with respect to the paper web transport direction. The blade 7 is provided for removing surplus coating liquid to form a film of coating liquid having a constant thickness on the web of paper 3. In addition, for the purpose of damming up the coating liquid within a chamber 4, a dam plate 8 is disposed at the upstream side of the apparatus with respect to the paper web transport direction.

With regard to the short dwell coater shown in FIG. 3, some of the coating liquid injected through opening 9 is transferred onto the web 3, the remainder of the coating liquid which has reached the blade 7 as a result of the transportation of the same web becomes surplus liquid and is mixed with the newly supplied coating liquid, and the mixed coating liquid circulates within the chamber 4 as indicated at 12. Part of the circulating coating liquid does not flow out beyond the dam plate 8.

In such a coating apparatus, when coating liquid having a large amount of hydrophobic pigment is employed, when employing coating liquid containing a binder in a small proportion, or when the web speed is high (800 m/min. or higher) and when the ability of the web to absorb water has been lowered by pretreatment, the thickness of the coating liquid becomes uneven in the widthwise direction of the web even if metering is effected by means of the blade 7. Hence, the thickness of a film on the final product would be also adversely influenced. That is, when the coated paper web is looked through, or is observed under a fluorescent exciting lamp if the coating liquid contains fluorescent dye, in some cases a belt-like unevenness of the film is observed.

The coating liquid in the prior art as shown in FIG. 9 would circulate within the chamber, owing to the upward pressure and the scraping of the coating liquid by the blade 7. However, the circulating flow is not uniform along the widthwise direction of the web, especially when the machine operates at a high speed. And in some cases, the liquid layer coated on the web would not have an even thickness.

SUMMARY OF THE INVENTION

It is therefore one object of the present invention to provide an improved coating apparatus which can apply a coating of liquid onto a web at a uniform thickness, especially with respect to the widthwise direction of the web.

According to the present invention, there is provided a coating apparatus for coating a web which is being transported as wrapped around a backing roller, which apparatus comprises a blade for scraping the coating liquid on the web into a film having a constant thickness, a chamber for storing the coating liquid, a blow-off section defining a liquid feeding passage open to the bottom of the chamber, a partition plate provided within the chamber for dividing the inside of the chamber in the traveling direction of the web, a plate-like body mounted to an upper portion of the partition plate and resiliently held in contact with the web, and a plurality of holes formed in a lower portion of the partition plate.

According to the present invention, owing to the above-mentioned structural features, coating liquid delivered from the blow-off section is mixed with the coating liquid in a section of the chamber on the downstream side with respect to the web traveling direction, and then enters the section of the chamber on the upstream side through the plurality of holes formed in the partition plate. The coating liquid having reached and adhered to the web in the above-described section of the chamber on the upstream side, forcibly opens the plate-like body resiliently held in contact with the web due to the travel of the web, and arrives at the blade. At this time, surplus coating liquid descends along the blade and fills the section of the chamber on the downstream side. At the same time, the surplus coating liquid raises the pressure in that chamber section and is mixed with coating liquid fed from the blow-off section. Most of the mixed coating liquid flows out into the section of the chamber on the upstream side through the plurality of holes in the partition plate. As per such an operation, the coating liquid can be transferred onto the web uniformly in the widthwise direction of the web owing to the array of holes in the partition plate, and by making the back pressure applied to the plate-like body resiliently held in contact with the web uniform by proper selection of the cross-sectional area of the holes.

The above-mentioned and other objects, features and advantages of the present invention will become more apparent by referring to the following description of preferred embodiments of the invention taken in conjunction with the accompanying drawings.

DETAILED DESCRIPTION OF THE PREFERRED EMBODIMENTS

Figure 1:
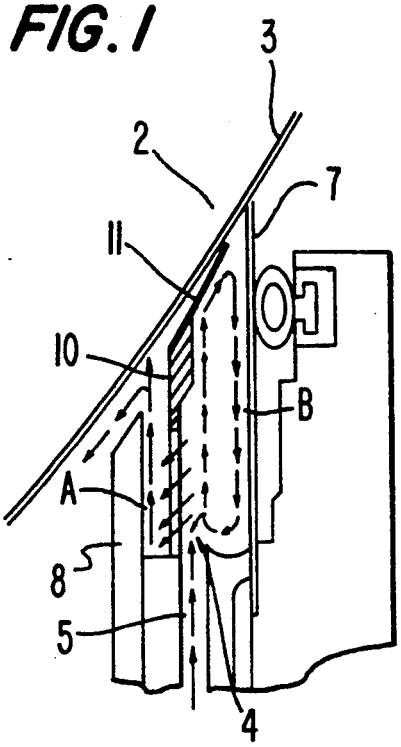
FIG. 1 is a longitudinal sectional view of a coating apparatus according to a first preferred embodiment of the present invention.

Now the present invention will be described in greater detail in connection with the preferred embodiments illustrated in FIGS. 1 and 2. In these figures, reference numeral 2 designates a backing roller, numeral 3 designates a web, numeral 4 designates a chamber for storing and blowing off coating liquid, numeral 5 designates a coating liquid blow-off section defining a liquid feed passageway open to the bottom of the chamber 4, numeral 7 designates a blade, and numeral 8 designates a dam plate. In addition, reference numeral 10 designates a partition plate having a large number of holes formed therein. This partition plate 10 is fixed in the apparatus so as to divide the inside of the chamber 4 in the traveling direction of the web into an upstream side chamber section A and a downstream side chamber section B. A resilient body 11 is mounted to an upper portion of the partition plate as directed in the direction of travel of the web such that coating liquid fed from the liquid feeding passageway at the bottom of the chamber 4 and surplus coating liquid scraped from the surface of the web 3 by the blade 7 flow as separate streams which then circulate in chamber B as shown by the arrows.

Next, the operation of the above-described coating apparatus will be explained. When coating liquid flowing out from the passageway defined by the blow-off section 5 fills the chamber section A on the upstream side of the apparatus with respect to the web traveling direction and fills the chamber section B on the downstream side of the apparatus with respect to the same direction, the coating liquid comes into contact with the web 3 and forcibly opens the resilient body 11 as a result of the force under which the coating liquid is propelled by the web 3. The coating liquid thus passes through the gap between the web and the resilient body 11 and reaches the blade 7. Because the liquid coated on the web is controlled by the blade 7 so as to have a predetermined thickness, a film of coating liquid of such thickness passes the blade 7 jointly with the web 3 while surplus coating liquid flows down along the blade 7 and is mixed with newly fed coating liquid. A part of the mixed coating liquid passes through the holes in the partition plate 10, thus entering the chamber section A and again reaching the web 3. But the remainder of the mixed coating liquid merely circulates in the chamber section B. Surplus coating liquid in the chamber section A is discharged to the outside of the coating apparatus through a gap between the dam plate 8 and the web 3. It is to be noted that the holes formed in the partition plate 10 could be circular holes, elongate holes or a combination of the same.

Figure 2:
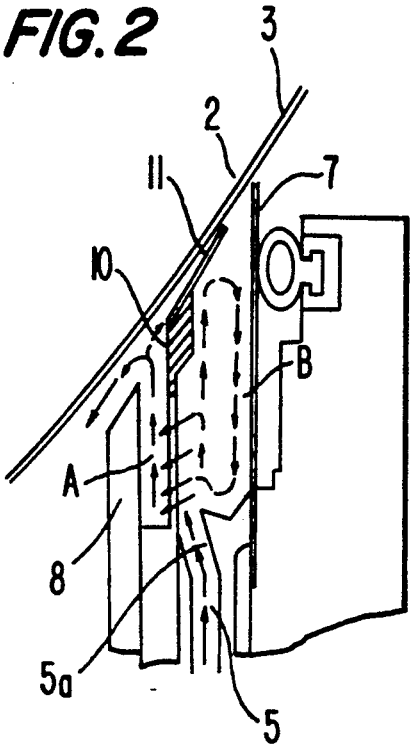
FIG. 2 is a longitudinal sectional view of a coating apparatus according to a second preferred embodiment of the present invention.
Figure 3:
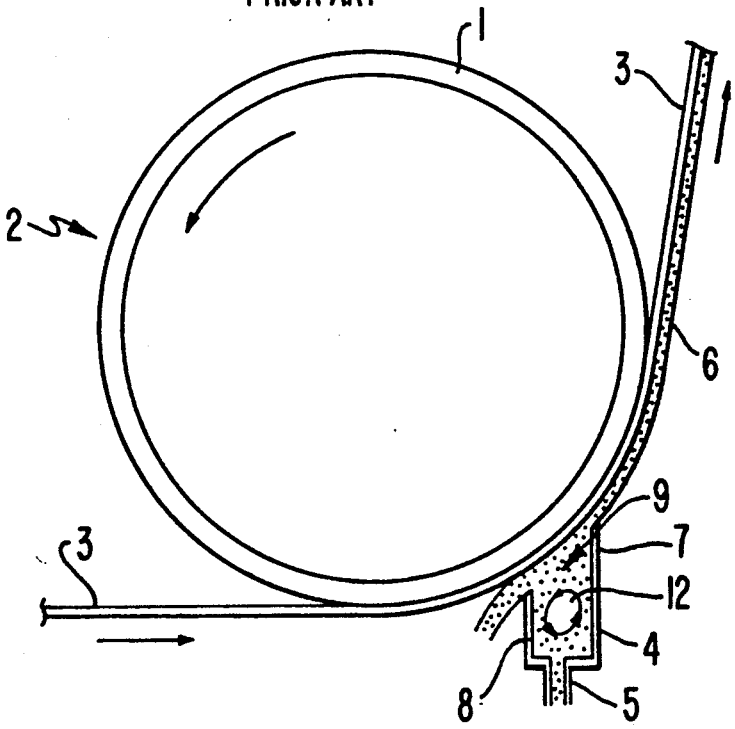
FIG. 3 PRIOR ART
FIG. 3 is a cross-sectional view of one example of a coating apparatus in the prior art.

FIG. 2 shows another preferred embodiment of the present invention. While the operating principle of this modified embodiment in nearly the same as that of the first preferred embodiment shown in FIG. 1, in this embodiment, the liquid feeding passageway defined by the blow-off section 5 is inclined as shown at 5*a* to direct the flow of coating liquid towards the lower portion of the partition plate 10 in which a plurality of holes are formed. Thus, newly fed coating liquid is introduced into the chamber section A so that coating liquid in the chamber section A may be made to flow as mixed with and driven by the newly fed coating liquid. With regard to effects and advantages, significant differences are not observed between the two preferred embodiments.

As will be obvious from the detailed description of the preferred embodiments above, according to the present invention, owing to the facts that a partition plate divides the chamber in the web traveling direction, that a plate-like body resiliently held in contact with the web is mounted to an upper portion of the partition plate, and that a plurality of holes are formed in a lower portion of the partition plate, coating liquid scraped from the web by the blade and newly fed coating liquid can be mixed and then provided with uniform characteristics along the widthwise direction of the web. In addition uneven swirl flows within the chamber can be prevented.

Furthermore, by appropriately selecting the cross-sectional area of the holes in the partition plate, the pressure in the downstream side chamber section can be varied. Hence, the back pressure of the resilient plate can be regulated. Also an osmotic pressure of the coating liquid to be transferred to the web can be regulated to transfer the coating liquid to the web uniformly along its widthwise direction, and air entrained by the backing roller is intercepted. On the other hand, although coating liquid scraped by the blade is distributed unevenly along the widthwise direction within the downstream side chamber section, this coating liquid is intercepted by the resilient body so as not to be reapplied to the web in the downstream side chamber section. Furthermore, the present coating apparatus has an advantage in that coating liquid having uneven characteristics along the widthwise direction within the downstream side chamber section is given a uniform viscosity along the widthwise direction after it has passed through the holes in the partition plate because a shearing effect is applied to the liquid when it passes through the holes. Accordingly, even if the web traveling speed is 800 m/min. or higher, the liquid film will have a uniform profile, and an osmotic pressure of the coating liquid will also be uniform.

While a principle of the present invention has been described above in connection with preferred embodiments of the invention, it is intended that all matter contained in the above description and illustrated in the accompanying drawings shall be interpreted to be illustrative and not in a limiting sense.

What is claimed is:

1. The combination of a backing roller and a coating apparatus confronting an outer circumferential surface of said backing roller for coating a web traveling in a web transport direction over said surface with a coating liquid, said apparatus including a plate-like member disposed at an upstream side of the apparatus with respect to the web transport direction, said plate-like member extending toward the outer circumferential surface of said backing roller, a blade disposed downstream of said plate-like member with respect to said web transport direction and biased in a direction toward the outer circumferential surface of said backing roller such that a chamber is defined between said blade and said plate-like member, a blow-off section defining a bottom of said chamber remote from the outer circumferential surface of said backing roller and a liquid feed passageway open to said chamber at the bottom thereof, a partition plate having upper and lower portions extending substantially parallel to said blade through said chamber toward the outer circumferential surface of said backing roller and spaced from said plate-like member and said blade in the web transport direction so as to divide said chamber into a first section delimited by said plate-like member and the partition plate on the upstream side of the apparatus and a second section delimited by said blade and the partition plate on the downstream side of the apparatus, and a resilient body fixed to the upper portion of said partition plate adjacent said backing roller and so disposed as to resiliently engage a web traveling in said web transport direction over the outer circumferential surface of said backing roller, said resilient body being oriented at an inclination relative to said partition plate and extending from said upper portion of the partition plate in a direction toward said blade, said resilient body and the outer circumferential surface of said backing roller defining a wedge-shaped space therebetween, said partition plate having holes extending through the lower portion thereof which place said first and said second sections in communication with one another, said liquid feeding passageway having an inlet end open to the bottom of said second section of said chamber at a location adjacent the lower portion of said partition plate, said blow-off section defining a bottom of said second section of the chamber extending between the inlet end of said liquid feed passageway and said blade such that the inlet end of said liquid feed passageway is spaced from the downstream side of the second section of said chamber with respect to the web transport direction, and said chamber being open at the bottom thereof only to said liquid feeding passageway such that when liquid is being fed into said chamber from said liquid feeding passageway the liquid must pass out of said first section of the chamber only toward the outer circumferential surface of said backing roll.

2. The combination of a backing roller and a coating apparatus as claimed in claim 1, wherein said liquid feed passageway is open to the second section of said chamber and extends obliquely relative to said partition plate in a direction toward said lower portion of the partition plate.

3. The combination of a backing roller and a coating apparatus as claimed in claim 1, wherein said plate-like member is a dam plate having a terminal end spaced from the outer circumferential surface of said backing roller so as to define a gap therebetween, whereby excess coating liquid passing out of the first section of said chamber toward a web traveling in the web transport direction over said backing roller is allowed to flow in a direction opposite to said web transport direction.

4. The combination of a backing roller and a coating apparatus confronting an outer circumferential surface of said backing roller for coating a web traveling in a web transport direction over said surface with a coating liquid, said apparatus including a plate-like member disposed at an upstream side of the apparatus with respect to the web transport direction, said plate-like member extending toward the outer circumferential surface of said backing roller, a blade disposed downstream of said plate-like member with respect to said web transport direction and biased in a direction toward the outer circumferential surface of said backing roller such that a chamber is defined between said blade and said plate-like member, a partition plate having upper and lower portions extending substantially parallel to said blade through said chamber toward the outer circumferential surface of said backing roller and spaced from said plate-like member and said blade in the web transport direction so as to divide said chamber into a first section delimited by said plate-like member and the partition plate on the upstream side of the apparatus and a second section delimited by said blade and the partition plate on the downstream side of the apparatus, said partition plate having holes extending through the lower portion thereof which place said first and said second sections in communication with one another, a blow-off section defining a liquid feeding passageway having an inlet end open to the second section of said chamber at a location adjacent the lower portion of said partition plate and a bottom of the second section of said chamber remote from the outer circumferential surface of said backing roller, the bottom of the second section of said chamber extending between the inlet end of said liquid feed passageway and said blade such that the inlet end of said liquid feed passageway is spaced from the downstream side of the second section of said chamber with respect to the web transport direction, and a resilient body fixed to the upper portion of said partition plate adjacent said backing roller and so disposed as to resiliently engage a web traveling in said web transport direction over the outer circumferential surface of said backing roller, said resilient body being oriented at an inclination relative to said partition plate and extending from said upper portion of the partition plate in a direction toward said blade, and said resilient body and the outer circumferential surface of said backing roller defining a wedge-shaped space therebetween.

5. The combination of a backing roller and a coating apparatus as claimed in claim 4, wherein said liquid feed passageway extends obliquely relative to said partition plate in a direction toward said lower portion of the partition plate.

6. The combination of a backing roller and a coating apparatus as claimed in claim 4, wherein said plate-like member is a dam plate having a terminal end spaced from the outer circumferential surface of said backing roller so as to define a gap therebetween, whereby excess coating liquid passing out of the first section of said chamber toward a web traveling in the web transport direction over said backing roller is allowed to flow in a direction opposite to said web transport direction.

* * * * *